US006357382B1

(12) United States Patent
Clark

(10) Patent No.: US 6,357,382 B1
(45) Date of Patent: Mar. 19, 2002

(54) AUDIBLE WARNING DEVICE WITH RESTRAINABLE, TILT-ACTIVATED MECHANISM

(76) Inventor: Lloyd Douglas Clark, 15 Conrad St., San Francisco, CA (US) 94131

( * ) Notice: Subject to any disclaimer, the term of this patent is extended or adjusted under 35 U.S.C. 154(b) by 0 days.

(21) Appl. No.: 09/542,132

(22) Filed: Apr. 4, 2000

(51) Int. Cl.[7] ..... G08B 13/02
(52) U.S. Cl. ..... 116/137 R; 116/215
(58) Field of Search ..... 116/203, 215, 116/137 R, 209, 67 R, 78, 83, 82, 4, 5; 33/391, DIG. 2

(56) References Cited

U.S. PATENT DOCUMENTS 1,812,234 A * 6/1931 Braatelien ..... 239/519
2,056,494 A * 10/1936 Tucker, Jr. et al. ... 200/61.45 R
2,840,033 A * 6/1958 Nitchman ..... 116/112
3,592,156 A * 7/1971 Prachar ..... 116/203
4,230,450 A * 10/1980 LeFever ..... 431/361
4,762,082 A * 8/1988 Suchevits ..... 116/87
5,007,368 A * 4/1991 Bush ..... 116/211
5,682,834 A * 11/1997 Croghan ..... 116/4

* cited by examiner

*Primary Examiner*—Diego Gutierrez
*Assistant Examiner*—R. Alexander Smith

(57) ABSTRACT

A shock-activated, sonic alarm is silent when in an armed or cocked condition. In this condition, a spring-loaded lance (108) is restrained by a ball (104) from activating an alarm (100). When the alarm is tilted, or dealt a sharp blow, the ball (104) is dislodged and frees the lance (108) to pierce a membrane in a gas cylinder (102), resulting in a loud alarm. Alternatively, a normally-closed switch (208) is held in an open condition by a ball (204). When the ball (204) is dislodged from its position on the plunger (207) of the switch (208), a buzzer (212) is activated, resulting in a loud sound. The alarm can be placed in any location where it is desirable to sound an alarm in response to a physical trauma, such as in a traffic barrier or dangerous goods shipment.

17 Claims, 5 Drawing Sheets

AUDIBLE WARNING DEVICE WITH RESTRAINABLE, TILT-ACTIVATED MECHANISM

BACKGROUND—FIELD OF INVENTION

This invention relates generally to audible warning devices, and in particular to warning devices which are activated by being tilted from an initial, deactivated position.

1. Prior-Art—Barriers

Road construction is a dangerous occupation. Because of their proximity to traffic, road workers are occasionally struck by vehicles and maimed or killed. At present, they are minimally protected by warning signs which advise drivers in advance of the presence of the workers. Nearer the work site, brightly colored cones or poles are placed on or near the roadway to direct vehicles around the workers and their equipment. Frequently, there are no rigid barriers which can stop errant vehicles which might injure the workers.

Unfortunately, workers are frequently unaware of approaching danger. They cannot always watch traffic while they work. A careless motorist may drive through flimsy, temporary barriers almost noiselessly and strike a worker who is unable to get out of the way of the approaching vehicle.

Most temporary barriers are made of a flexible, plastic material. When these are struck by a moving vehicle they are deflected, or they deform as the vehicle passes over them. In both cases, the interaction of the barrier with the moving vehicle is virtually silent. In many cases, the worker is in the vicinity of loud machinery and is unable to hear the vehicle as it approaches, even though the barrier is struck or knocked over by the vehicle.

2. Prior-Art—Civil Disobedience or Hostage Situations

Situations involving civil disobedience and hostages are dangerous to all involved. Tear gas and concussion grenades are sometimes used to confuse the perpetrators long enough for law enforcement personnel to gain the upper hand. Both of these methods are potentially more destructive to personnel and property than the situation merits.

3. Prior-Art—Transport of Fragile or Dangerous Materials

Fragile and dangerous materials are often subject to damage or leaking when their container is shocked or tilted. For example, a plastic bottle containing a flammable substance may leak in the cargo hold of an airplane, placing the passengers, crew, and other cargo at risk from fire or fumes. At present, there is no way for persons in the vicinity to know that a delicate package has been dropped, tilted, or bumped hard enough to cause breakage of its contents.

OBJECTS AND ADVANTAGES

Accordingly, one object and advantage of the present invention is to provide an improved method of protecting workers who are required to work behind a physical barrier in the proximity of moving vehicles. Other objects are to provide an indication which is associated with a visible barrier, to provide an audible alarm which will alert the operator of a vehicle when the vehicle has struck or tipped over a barrier, to provide an audible alarm which will alert other drivers in the vicinity that a barrier has been struck or tipped over, to provide an alarm which additionally gives a visual indication of its activation, to provide an alarm which creates a diversion but is not harmful or destructive to personnel or property, and to provide an audible indicator for use in delicate or dangerous goods shipments.

Additional objects and advantages will become apparent from a consideration of the drawings and ensuing description thereof

SUMMARY

In accordance with the present invention, a method, and apparatus are provided which use a plurality of visible and audible warning devices to audibly alert all personnel in the vicinity of a barrier that the barrier has been breached. An audible alarm is provided which is activated by a physical trauma such as caused by a blow or by being tilted. In order that the alarm not activate unintentionally, the acceleration associated with a physical blow, or the degree of tilt must exceed a certain threshold. Visible indication of an activated alarm is optionally provided by emission of a colored dye cloud into the air surrounding the alarm device. Additionally, an odorant or tissue-irritating substance can be released by the alarm device.

DRAWING FIGURE REFERENCE NUMERALS

Figure 1:
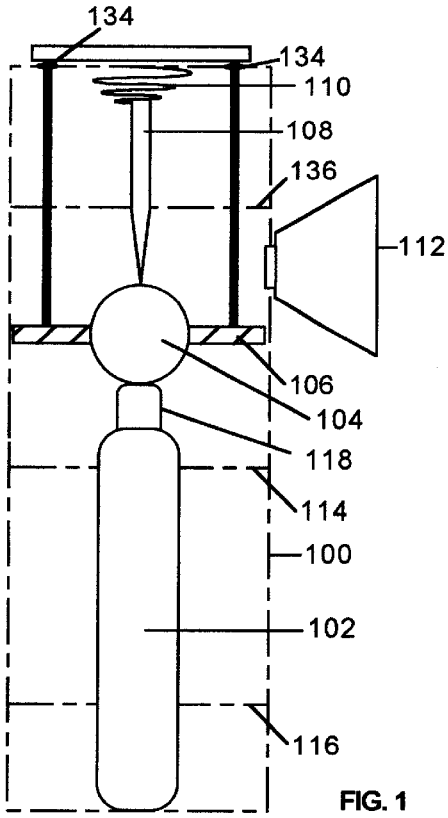
FIG. 1 is a cross-sectional view of a gas-powered alarm, showing a lance withheld by a ball and the ball in a restrained condition, in accordance with the present invention.

100 Alarm system housing
102 Cylinder
103 Gas
104 Ball
105 Cloud
106 Restraint
107 Hole
108 Lance
110 Spring
112 Horn
114 Restraint
115 Hole
116 Restraint

118 Neck
120 Cup
132 Rod
134 Gasket
136 Guide
138 Holes
140 Hole
150 Sound waves
200 Alarm system housing
202 Battery
204 Ball
206 Restraint
207 Plunger
208 Switch
214 Restraint
215 Block
216 Restraint
220 Wire
222 Wire
230 Handle
232 Rod
250 Sound waves
300 Insulating ball
302 Spring
304 Spring
400 Cone
402 Hook First Preferred Embodiment—Compressed Gas Powered Alarm—FIGS. 1 through 5

The embodiment of FIGS. 1 to 5 is a gas-powered alarm which can be used in road traffic situations to alert highway workers to any dangerous breach in the perimeter of their work area.

FIGS. 1–5—Storage Condition—Alarm Silent

A cross-sectional view of a preferred embodiment of the present alarm system is shown in FIG. 1 in its silent, or inactivated state. In this embodiment, a sonic generator principally comprises a gas-tight housing 100, a compressed gas cylinder 102, a spring 110, an activating lance 108, a lance-restraining hardened ball 104, a ball-holding movable restraint 106, and a gas-powered horn assembly 112. Compressed gas cylinder 102 comprises an energy storage member whose energy is converted into sound by horn assembly 112 when the alarm system is activated. One type of gas-powered horn assembly is sold by Aqua Signal Corporation, 1680 E. Fabyan Parkway, Batavia, Ill. 60510, USA.

Housing 100 is preferably cylindrical in shape, typically 3.81 cm (1.5 in) in diameter, and 11.43 cm (4.5 in) long. It contains support members 114 (FIG. 4) and 116 which hold gas cylinder 102 in place at the axis of cylinder 100. The diameter of hole 115 (FIG. 4) at the center of support 114 is very slightly larger than the outside diameter of cylinder 102, typically 1.27 cm (0.5 in). Gas cylinder 102 is preferably a familiar $CO_2$ container of the type used to charge seltzer bottles. These cylinders are sold by iSi Industrial Products, 30 Capin Road, Pine Brook, N.J. 07058 USA. In this embodiment, annular support members 114 and 116 are identical; therefore member 116 is not shown in a separate figure. Support 114 may be alternatively located axially at neck 118 of cylinder 102. In this case, support 114 would have a hole which is just slightly larger than the diameter of neck 118. Although a round cross-section is shown, other cross-sectional shapes such as oval, rectangular, and the like are possible.

Ball 104 rests on the top of neck 118 of cylinder 102. Neck 118 contains a membrane (not shown) of relatively soft metal. This membrane is recessed slightly from the top of neck 118. This recessed area forms a cup 120 (FIG. 5) upon which ball 104 rests.

Figure 2:
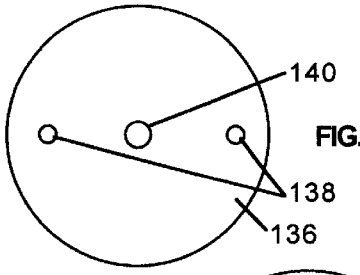
FIG. 2 shows a guide member used in the embodiment of FIG. 1.

Lance 108 is urged downward against ball 104 by spring 110. Lance 108 is typically made of hardened steel. Ball 104 is also hardened and is not dented by the sharp tip of lance 108. Ball 104 is thus held tightly against cup 120 (FIG. 5) of neck 118 of cylinder 102. Lance 108 is centered on the axis of cylinder 102 by sliding-fit hole 140 in guide 136 (FIG. 2).

Figure 3:
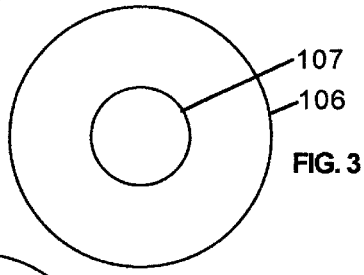
FIG. 3 shows a support member used in the embodiment of FIG. 1.
Figure 4:
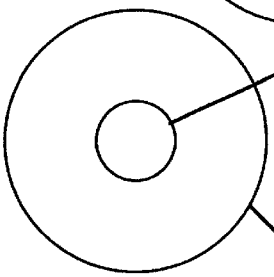
FIG. 4 shows a support member used in the embodiment of FIG. 1.
Figure 5:
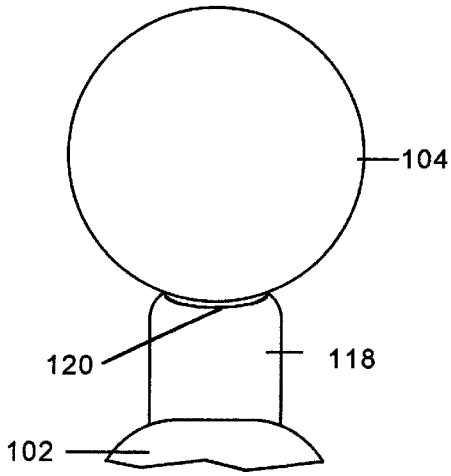
FIG. 5 is a detail view of a ball resting on the neck above the seal of a compressed gas cylinder.

Ball 104 is prevented from moving radially by movable restraint 106 (FIG. 3). The diameter of hole 107 in restraint 106 is very slightly greater than the diameter of ball 104, typically 1.59 cm (⅝ inch). When restraint 106 is at the axial position shown, the alarm system is unarmed, or deactivated. The alarm system will not emit an alarm even when tilted to any angle or subjected to physical trauma.

Figure 6:
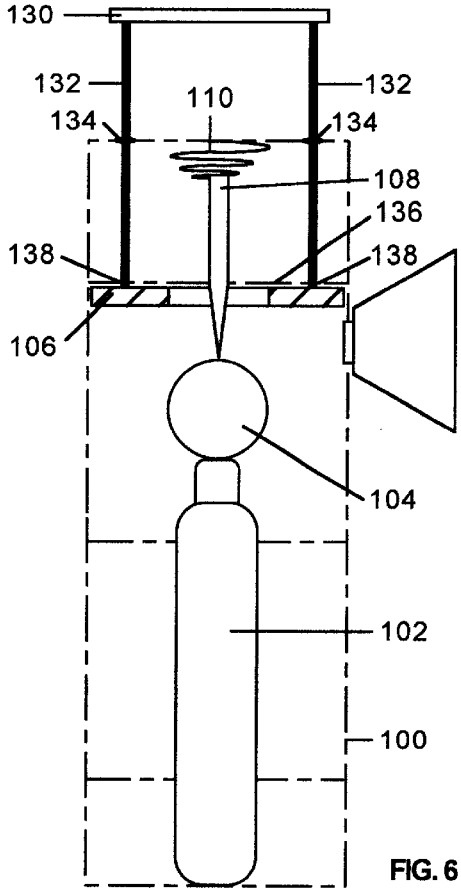
FIG. 6 is a cross-sectional view showing the alarm in an armed condition.

FIG. 6—Armed Condition—Alarm Silent

Movable restraint 106 is connected to handle 130 by identical rods 132. Rods 132 pass through tight-fitting gaskets 134 in the wall of housing 100. They also pass through holes 138 in guide 136 (FIG. 2).

To arm the alarm system, handle 130 is pulled upward, until movable restraint 106 rests against support member 116. Ball 104 is now prevented from moving perpendicular to the axis of cylinder 102 only by the force supplied by spring 110, communicated through lance 108. The lip of cup 120 provides a counter force. Only a small increase in potential energy of ball 104 is required to move ball from this precarious position.

Figure 7:
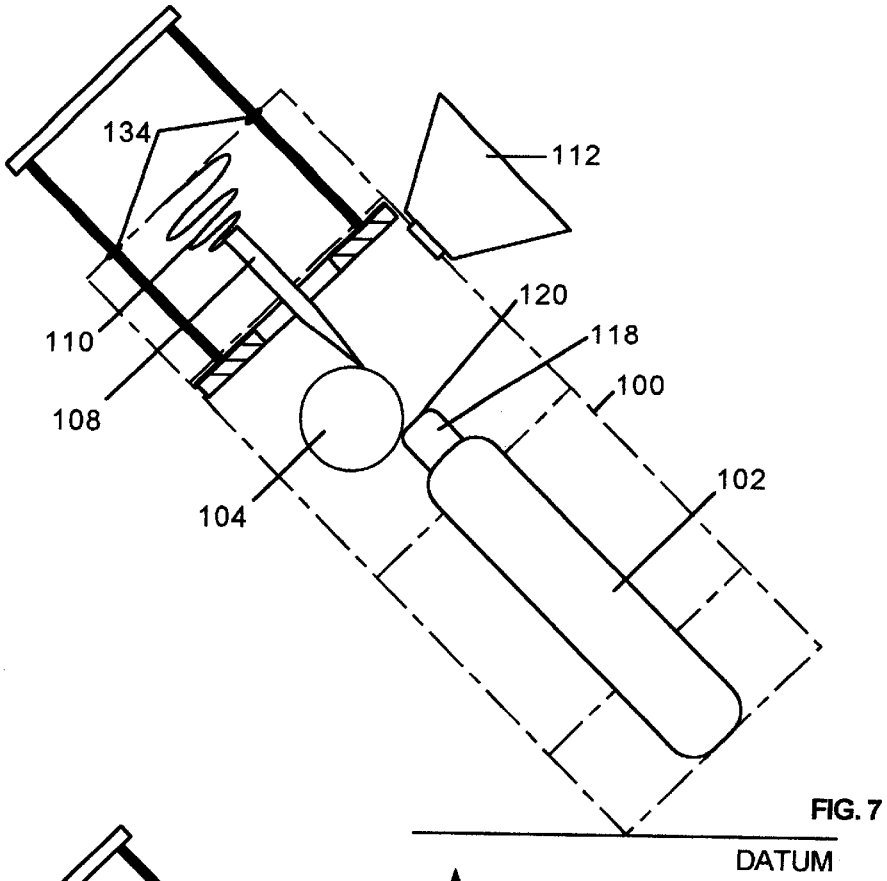
FIG. 7 shows the alarm of FIG. 6 in transition between armed and alarming conditions.
Figure 8:
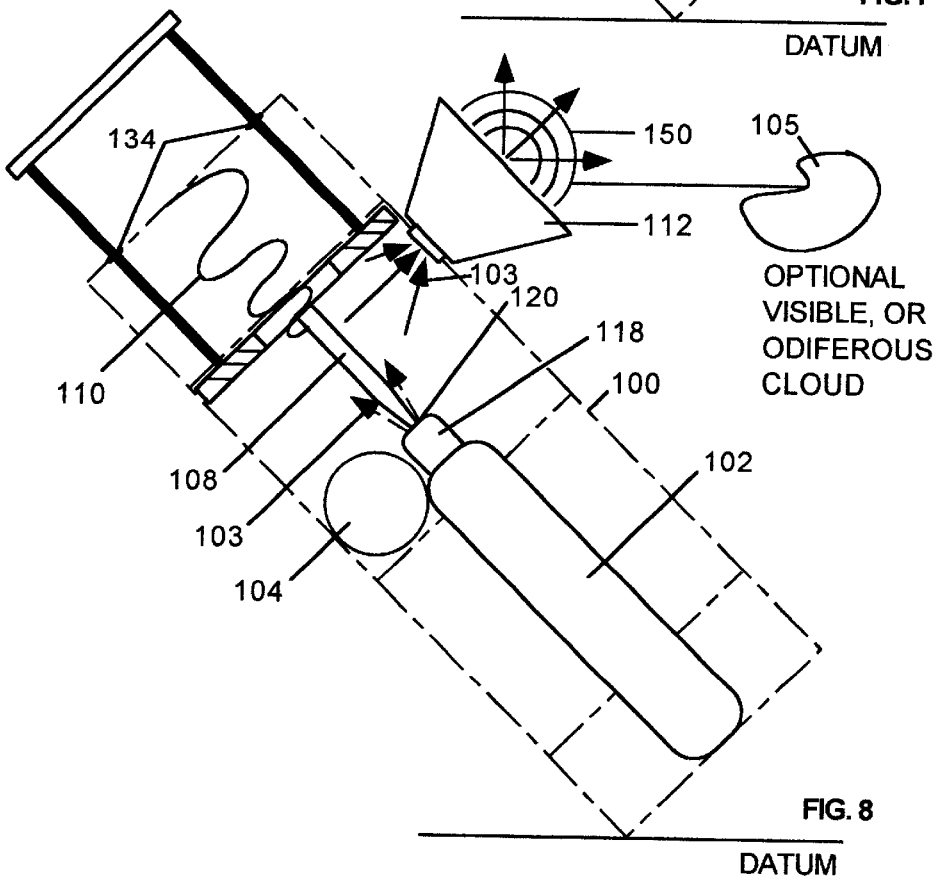
FIG. 8 is a cross-sectional view of the alarm of FIG. 6 in the alarming condition.

FIGS. 7 and 8—Alarming Condition

The increase in energy required to dislodge ball 104 from the lip of cup 120 can be supplied by an impulsive physical trauma to housing 100, or it can be supplied by centrifugal force with a radial component perpendicular to the axis of cylinder 102. It can also be supplied by tilting housing 100 until, under the action of gravity, ball 104 exerts sufficient force to compress spring 110 an amount slightly greater than the depth of cup 120. At this point, ball 104 will fall away from cup 120.

Lance 108 is now springably urged toward cup 120, which contains a relatively soft, metallic membrane seal (not shown) in neck 118 of cylinder 102. Spring 110 is sufficiently strong to cause lance 108 to penetrate the membrane seal in neck 118. Gas 103 contained in cylinder 102 is typically under very high pressure, 60 bar (870 psi). This pressure is sufficient to displace the tip of lance 108 and cause release of gas 103 into housing 100 (FIG. 8).

Gaskets 134 prevent the escape of gas along rods 132 at the wall of housing 100. The only path for the escape of the gas is via gas-powered horn assembly 112. The escape of gas through horn 112 results in a very loud noise, indicated schematically by sound waves 150 (FIG. 8).

The sensitivity of the alarm system to tilt, radial forces, and physical trauma can be varied by changing the diameter of ball 104, or the depth of cup 120. A smaller ball decreases sensitivity to tilt and trauma because it nests further into cup 120, and because it weighs less, resulting in a smaller downward force when the alarm system is tilted. A larger and deeper cup 120 results in decreased sensitivity because ball 104 must acquire more energy to be dislodged when it nestles further into cup 120. Thus the smaller the ball, the greater the force needed to activate the alarm.

Gas 103 in cylinder 102 may contain a colorant or an odorant. When a colorant is present, a visible gas cloud 105 is emitted when horn 112 sounds. The combination of sound 150 and cloud 105 permits rapid location of the alarm.

Figure 9:
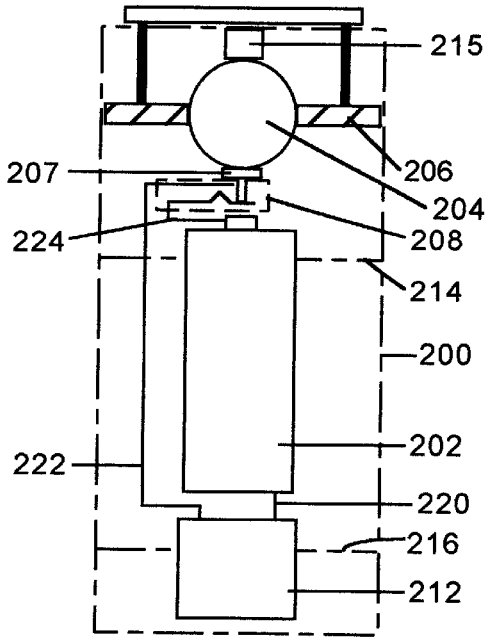
FIG. 9 is a cross-sectional view of an electrically powered embodiment of the alarm, in accordance with the present invention.
Figure 10:
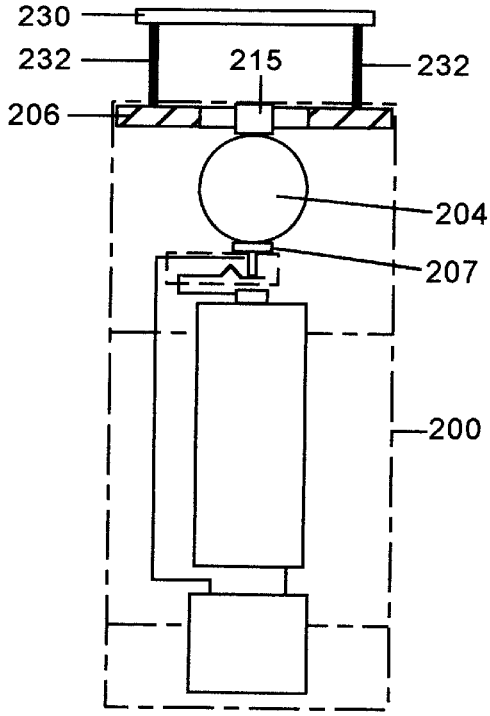
FIG. 10 shows the alarm of FIG. 9 in the armed state.
Figure 11:
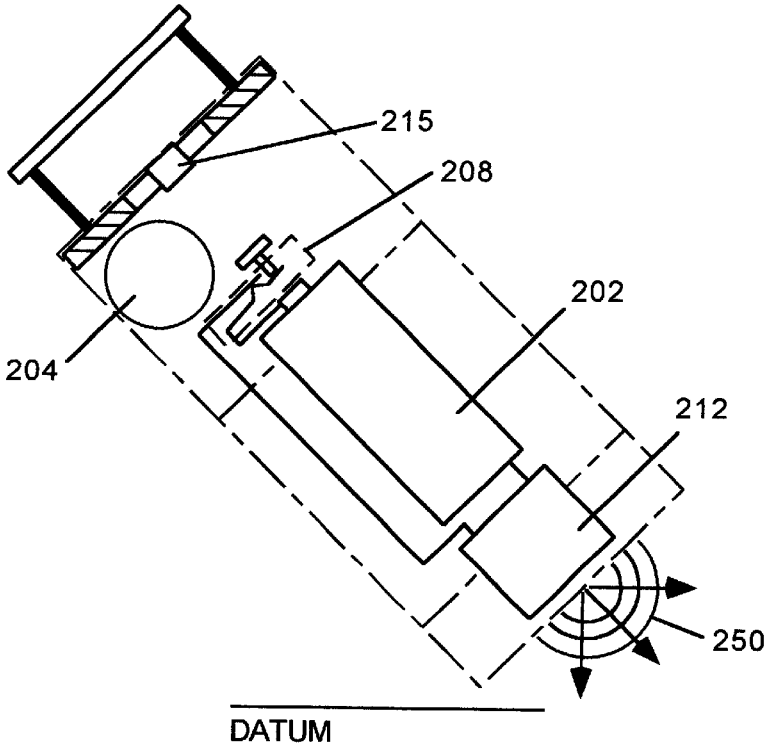
FIG. 11 shows the alarm of FIG. 9 in the alarming state.

Second Preferred Embodiment—Electrically-Powered Alarm—FIGS. 9, 10, and 11

The alarm in FIGS. 9, 10, and 11 is another embodiment which resembles and is equivalent in function to the alarm in FIGS. 1 through 8. In this embodiment however, the internal noise-making components are different.

FIG. 9—Storage Condition—Alarm Silent

The electrically powered embodiment of the sonic alarm system mainly comprises a housing 200 of size similar to that of the gas-powered alarm of FIG. 1. System 200 also has a battery 202, a switch-restraining ball 204, an activating switch 208, a sonic generator buzzer 212, and a ball-holding movable restraint 206. Battery 202 comprises an energy storage member whose energy is converted into sound when the alarm system is activated. A commercially available buzzer unit is sold by Matsushita, Inc. of Japan, under the mark "Panasonic". For example, their model EFB-RM38C13 emits a 3.5 kHz sound with an intensity of 96 decibels (dB) when energized with 10 volts. The diameter of the buzzer is 29 mm (1.14 inch). A suitable battery is the model LC-R121R3PU, also sold under the "Panasonic" mark. The size of this battery is 9.7×4.75×5 cm (3.8×1.9×2.0 inch). A suitable switch is model 8533MCQE2, manufactured and sold by C&K Components, Inc., of Watertown, Mass. U.S.A. This switch is a single-pole, single-throw, momentary, normally-closed type. Its size is 0.81×0.51×0.86 cm (0.32×0.2×0.34 inch). Switch 208 generally contains a spring (not shown) which normally holds its internal contacts (not shown) in contact with one-another.

Annular support members 214 and 216 serve a purpose similar to that described above in connection with members 114 and 116 (FIG. 1). They hold battery 202, switch 208, and buzzer 212 at the axis of housing 200. Although a circular cross-section is shown, other cross-sectional shapes such as oval, rectangular, and the like are possible.

The inside diameter of housing 200 is large enough to accommodate the larger of buzzer 212 or battery 202. Switch 208 is typically smaller than either buzzer 212 or battery 202. For example, the diameter of the Panasonic brand buzzer described above is 29 mm (1.14 inch). Wire 220 connects one pole of battery 202 to a first terminal (not shown) on buzzer 212. Wire 222 connects switch 208 to a second terminal (not shown) on buzzer 212. Switch 208 is a normally-closed, single-pole, single-throw switch.

Ball 204 is held in place between plunger 207 of switch 208 and block 215. Block 215 is affixed to the inside, top of housing 200. Plunger 207 and block 215 can have cup-shaped indentations in contact with ball 204, if desired. The diameter and depth of such an indentation, along with the restoring force (not shown) against the plunger, will determine the sensitivity of alarm assembly 200 to tilt or physical trauma. Ball 204 is restrained from moving radially by movable restraint 206. In this condition, alarm 200 will not sound.

FIG. 10—Armed Condition—Alarm Silent

Operation of the electrically-powered alarm of FIGS. 9, 10, and 11 is similar to that of the gas-powered alarm in FIGS. 1 through 6. Handle 230 is withdrawn until restraint 206 is in contact with the inside, top of housing 200. Ball 104 is now precariously held between block 217 and plunger 207 of switch 208.

FIG. 11—Alarming Condition

When a shocking or radial force is applied to alarm housing 200, or when housing 200 is tilted, ball 204 is dislodged from its rest position between the plunger of switch 208 and block 215. The contacts of normally-closed switch 208 close, energizing buzzer 212 and causing it to emit a loud, continuous shriek 250. Sound 250 will continue until the charge of battery 202 is depleted.

Figure 12:
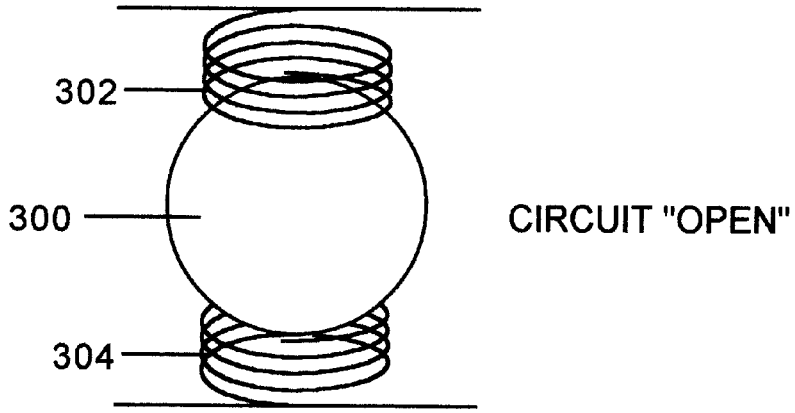
FIG. 12 shows an alternative switch mechanism with the circuit open.
Figure 13:
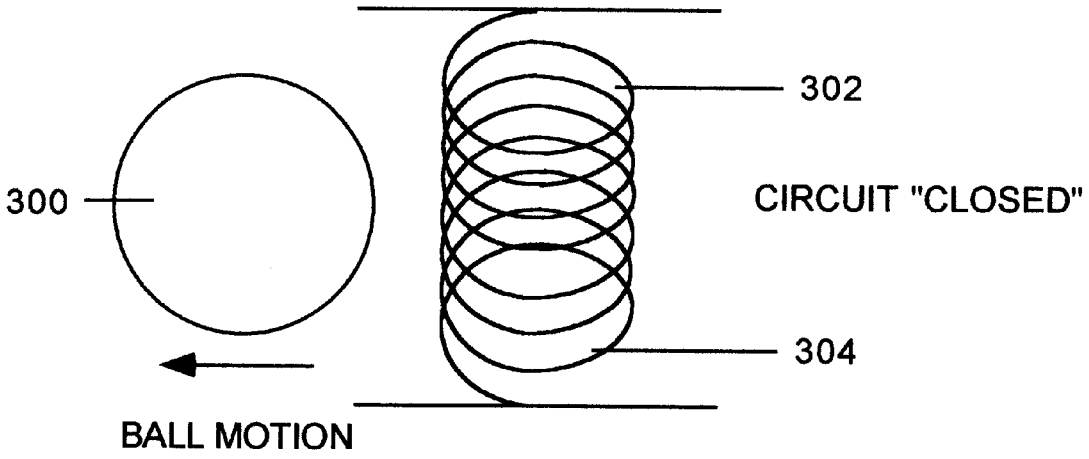
FIG. 13 shows the alternative switch mechanism of FIG. 12 with the circuit closed.

Alternative Switch Mechanism—FIGS. 12 and 13

An alternative switch design is shown in FIGS. 12 and 13. This arrangement replaces commercially available switch 208 described above. An insulating ball 300 is held in place between two metallic springs 302 and 304. With restraint 206 (FIG. 10) removed, ball 300 is free to move perpendicular to the axis of springs 302 and 304. When housing 200 is tilted, ball 300 falls away from the spring axes, allowing metallic springs 302 and 304 to contact, closing the circuit between battery 202 and buzzer 212 (FIG. 11).

Figure 14:
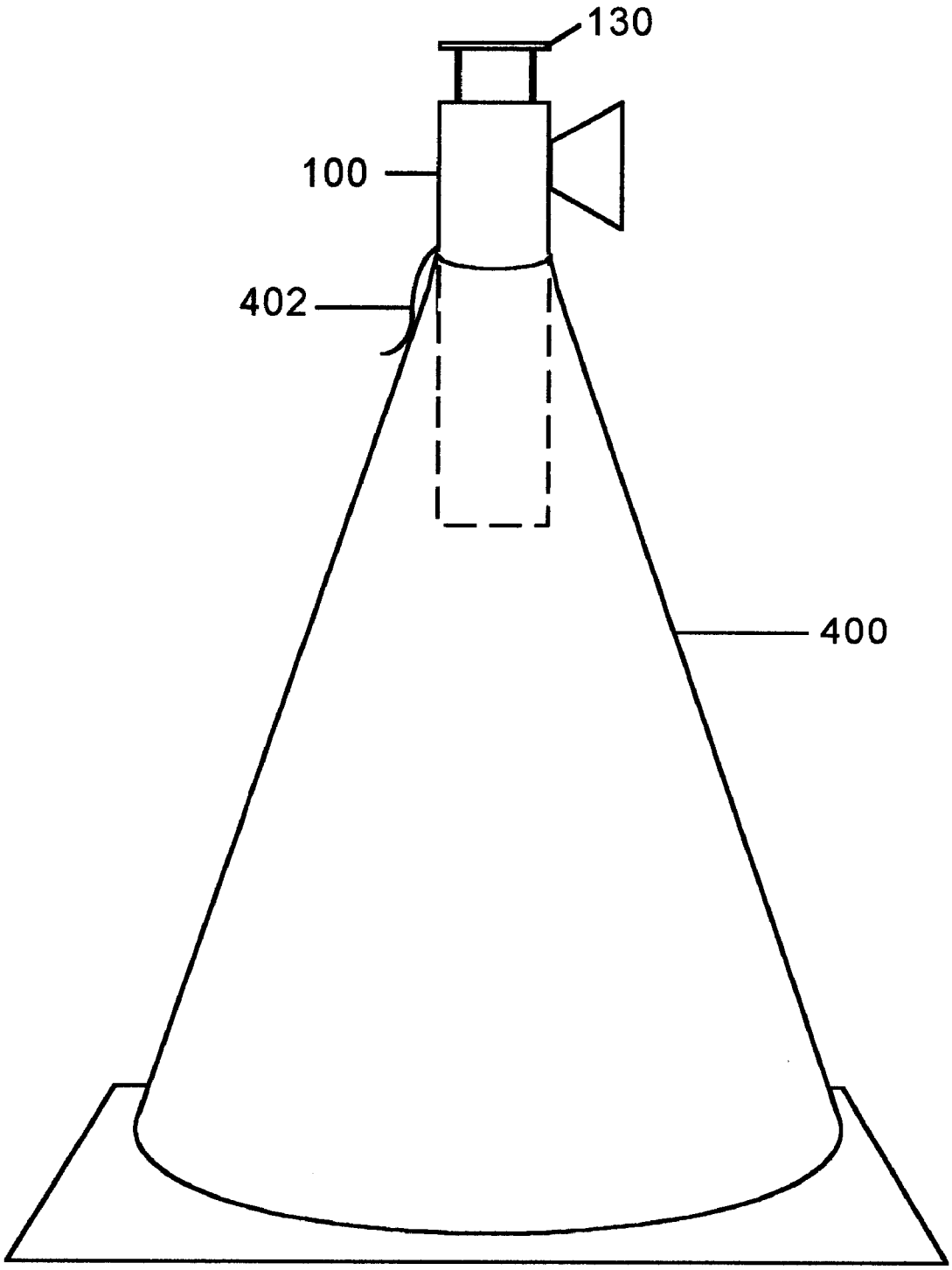
FIG. 14 shows the alarm of FIG. 1 placed in a traffic cone.

Application of Alarm System—FIG. 14

One embodiment of the alarm is shown mounted in a familiar, soft plastic traffic cone 400. Cone 400 is typically 0.6 meter (2 ft) tall. It is truncated at its top. This permits insertion of the body of the alarm. Hook 402 has been added to outer case 110 (FIG. 1) in order to support the alarm in cone 400. Since handle 130 is raised, the alarm will be activated when struck or tilted by a moving vehicle.

In use, at least one cone 400 containing the alarm is strategically placed within or at a protective barrier, for example a line of other cones, sawhorses, police tape, and the like, so that it will be struck or tilted if the barrier is breached. Thus when a vehicle enters the barrier it will strike or tip cone 400 and activate the alarm. When the alarm is activated, it sounds and alerts workers so that they can escape to safety, potentially preventing injury and saving lives.

Another problem solved by the present system is the defusing of civil disobedience or hostage situations. The alarm is armed, then thrown into the midst of a tense situation where it activates. Consider the example of a person with a gun who is threatening others inside a store. Law enforcement officers throw the alarm into the store. The person with the gun is distracted, and the officers can take control of the situation.

SUMMARY, RAMIFICATIONS, AND SCOPE

It is thus seen that the present system provides a warning when a barrier is breached. In particular, one form of the barrier is an inexpensive, movable barrier comprising plastic cones or poles, known as delineators. While the above description contains many specificities, these should not be construed as limitations on the scope of the invention, but rather as example of the preferred embodiment. Many other ramifications are possible. For example, the barrier concept also can be used in factories, mines, farms, and any place where notice must be given that the barrier has been breached.

The gas-powered embodiment of the alarm can also contain a colorant which forms a distinctive cloud when the alarm activates. In the case of road barriers, this can readily indicate the source of the alarm sound. In the case of the store situation, the colored cloud can further confuse and distract the person with the gun.

The gas-powered embodiment of the alarm can also contain a chemical which has a noxious odor or is an irritant. In the case of the store situation, the odor can further confuse and distract the person with the gun.

Another problem is solved by placing the alarm inside dangerous or fragile goods shipments. When the materials and alarm are subjected to a blow or tilted or dropped, the alarm sounds to alert personnel that the materials in the shipment may have been compromised. It can also be placed in any other location where it will be advantageous to create a loud sound when the alarm housing is subjected to tilt or a physical trauma.

The alarm can have shapes other than cylindrical. The actuator can be other than a cap or switch, for example a button or a lever, or the like. The actuating mechanism can be another type of gear or catch.

Other mechanical energy storing members can be a spring, a weight, and a liquid which changes state to become a gas.

While the present system employs elements which are well known to those skilled in the arts of mechanical and electrical engineering, traffic safety, and law enforcement, it combines elements from these fields in a novel way which produces a new result not heretofore discovered.

Accordingly the scope of this invention should be determined, not by the embodiments illustrated, but by the appended claims and their legal equivalents.

I claim:

1. A sonic generator for producing an audible alarm, comprising:

a. a housing for holding an activating member, a storage unit, a horn, an energy storing member, a gravitationally responsive restraining member, and a holding member, b. said horn being arranged to receive energy from said storage unit and convert said energy into a loud sound when said activating member is released, c. said energy storing member arranged to urge said activating member in a predetermined direction, d. said gravitationally responsive restraining member arranged to restrain said activating member from moving in said predetermined direction, e. said holding member arranged to hold said restraining member such that said restraining member and said activating member are not activatable, f. said holding member being movable from said restraining member such that said gravitationally responsive restraining member and said activating member are activatable so that upon a predetermined amount of tilt or traumatic force to said housing, said gravitationally responsive restraining member relocates, causing said activating member to move in said predetermined direction, thereby activating said horn.

2. The sonic generator of claim 1 wherein said activating member is a lance, said storage unit is a compressed gas cylinder, and said horn is operated by compressed gas.

3. The sonic generator of claim 2 wherein said compressed gas cylinder contains a colored gas.

4. The sonic generator of claim 2 wherein said compressed gas cylinder contains a gas with an odorant.

5. The sonic generator of claim 1 wherein said energy storing member is a spring.

6. The sonic generator of claim 1 wherein said activating member is a switch, said storage unit is a battery, and said horn is an electrically powered buzzer.

7. The sonic generator of claim 1, further including a hole in said housing for escape of said loud sound generated by said sonic generator.

8. The sonic generator of claim 1 wherein said holding member has an annular shape.

9. A method for producing an audible alarm comprising:

a. providing a sonic generator having a housing, a movable activating member, a storage unit, a horn, an energy storing member, a gravitationally responsive restraining member, and a movable holding member; said horn being arranged to receive energy from said storage unit and convert said energy into a loud sound when said activating member is released, said sonic generator having:

(1) a storage state wherein said holding member restrains said gravitationally responsive restraining member from moving, said gravitationally responsive restraining member being located to prevent said energy storing member from moving said activating member in a predetermined direction, (2) an armed state wherein said holding member is moved, allowing said gravitational responsive restraining member to respond to tilting or physical trauma so that if a movement of said gravitationally responsive restraining member occurs, said energy storing member is capable of moving said activating member in said predetermined direction, (3) an activated state in response to physical trauma or tilting having occurred to said housing, causing said activating member to move in said predetermined direction causing said sonic generator to convert said energy into said loud sound, b. placing said sonic generator while in said storage state in a position or on an object subject to physical trauma or tilting, and c. repositioning said holding member of said sonic generator so that said sonic generator is in said armed state.

10. The method of claim 9 wherein after step (c) the sonic generator is resettable from the armed state to the storage state.

11. The method of claim 9 wherein said activating member is a lance, said energy storage member is a compressed gas cylinder, and said horn is operated by compressed gas.

12. The method of claim 11 wherein said compressed gas cylinder contains a colored gas.

13. The method of claim 11 wherein said compressed gas cylinder contains a gas with an odorant.

14. The method of claim 9 wherein said activating member is a switch, said energy storage member is a battery, and said horn is an electrically operated buzzer.

15. The method of claim 9 wherein said housing includes a hole for escape of sound generated by said sonic generator.

16. The method of claim 9 wherein said housing has a round cross-section.

17. The method of claim 9 wherein said housing has an other than round cross-section.

* * * * *